United States Patent [19]

Meyers

[11] 4,123,038

[45] Oct. 31, 1978

[54] WHEEL LIFT

[76] Inventor: Gilbert D. Meyers, 2313 First Ave., Apt. 1334, Dodge City, Kans. 67801

[21] Appl. No.: 816,084

[22] Filed: Jul. 15, 1977

[51] Int. Cl.[2] ..... B66F 5/04

[52] U.S. Cl. ..... 254/2 R; 214/331; 254/134

[58] Field of Search ..... 254/2 R, 2 B, 133, 134; 214/1 D, 330, 331, 332, 335

[56] References Cited

U.S. PATENT DOCUMENTS

| | | | |
|---|---|---|---|
| 1,555,152 | 9/1925 | Passow | 214/331 |
| 2,600,741 | 6/1952 | Drum | 214/332 |
| 2,797,004 | 6/1957 | Miller | 254/2 R |
| 2,815,566 | 12/1957 | Hille | 214/1 D |
| 2,825,477 | 3/1958 | Ross | 214/1 D |
| 3,035,812 | 5/1962 | Wineteer | 254/2 R |
| 3,749,265 | 7/1973 | Smith | 21 4/331 |
| 3,850,419 | 11/1974 | Craig | 254/2 B |
| 3,951,287 | 4/1976 | Cofer | 214/331 |

*Primary Examiner*—Robert C. Watson

[57] ABSTRACT

A wheel lift apparatus for supporting a load, comprising a mobile base frame having caster mounted side frame members telescopically extensible in a longitudinal direction, a cross frame member rigidly interconnecting the side frame members in laterally fixed, substantially parallel relationship, and vertical guide means projecting upwardly from the cross frame member; a lift frame vertically movable relative to the base frame including laterally spaced L-shaped lift arms having horizontal, load supporting arm members and vertical arm members interconnected by a lateral cross member, and slide means carried by the vertical arm members for cooperable action with the guide members of the base frame; a horizontally adjustable load contacting frame carried by the vertical arm members of the lift frame; and another vertically adjustable, load supporting frame carried by the base frame.

9 Claims, 10 Drawing Figures

24
23
27
15a
26
38
32
44
17
41
30
42
35
34
10
36
28
5
5
15b
49b
25
48
60
56
13
55
54
6
6
53
57
60
25
37
32
44
12
30
11
33
27
41
9
9
24
23
25
22
15a
17
15
15b
49b
25
23
24
38
37
39
40
7
7
42
43
41
46

27
31
34
36
10
35
12
33
32
30
17
26
18
8
28
19
15b
21
15a
22
8
11

58
57
56
59
60
52
54
55
13
50
53
15b
51
23
25
48
49a

WHEEL LIFT

BACKGROUND OF THE INVENTION

The invention pertains generally to truck or dolly type apparatus for moving heavy objects as in manufacturing, assembly and distribution facilities, service centers and the like; and more particularly to an improved wheel lift for removing or installing large wheel-mounted tires and axle assemblies for agricultural implements and similar heavy vehicular equipment such as tractors, combines, fork lifts, trucks, etc.

Tractor tires, whether single or dual, and other large tires used on heavy agricultural or construction equipment are extremely heavy, difficult to handle and create a hazard to the persons handling them during the servicing of the vehicle or implement and/or during the repair or replacement of the tires. In installing heavy wheel and tire assemblies for tractors and other large vehicular equipment, it is particularly difficult to manipulate these assemblies so that the wheel hub bolts and wheel bolt holes are properly aligned, and the installation of tractor axle assemblies present similar problems of handling weight and obtaining proper alignment.

SUMMARY OF THE INVENTION

The present invention relates to a wheel lift apparatus for supporting a load, including a mobile base frame assembly having a cross frame member rigidly interconnecting parallel, telescopically extensible, side frame members, an L-shaped lift frame assembly vertically adjustably carried on the base frame assembly and including first load contacting means, second load contacting means carried by one of the base and lift frame assemblies, and horizontally adjustable means for varying the loading area of the first load contacting means.

A principal object of the present invention is to provide a wheel dolly or truck for supporting large vehicular wheel and tire assemblies or similar loads and for adjusting the vertical position of the supported load to facilitate the mounting and removal of such load from a vehicle.

Another object of the invention is to provide a wheel lift apparatus of simple and durable construction, capable of being economically manufactured, and easily maneuvered and used for supporting and lifting large wheels and axles to facilitate their installation on or removal from a vehicle.

A further object is to provide a wheel lift dolly constructed primarily of metal tubing to provide maximum strength with a minimum of weight.

Another object is to provide a wheel lift assembly having a first load support means for a primary load, such as dual wheel-mounted tractor tires, and a second load support means for a secondary load, such as an axle assembly for the dual tires.

Yet another object is to provide a wheel lift adapted for longitudinal adjustment to vary the loading area in order to accommodate single and dual tires, as well as tires of different sizes.

These and still other objects and advantages will become apparent hereinafter.

BRIEF DESCRIPTION OF THE DRAWINGS

In the drawings which illustrate preferred embodiments of the present invention, and in which like numerals refer to like parts wherever they occur.

DESCRIPTION OF THE PREFERRED EMBODIMENTS

Figure 1:
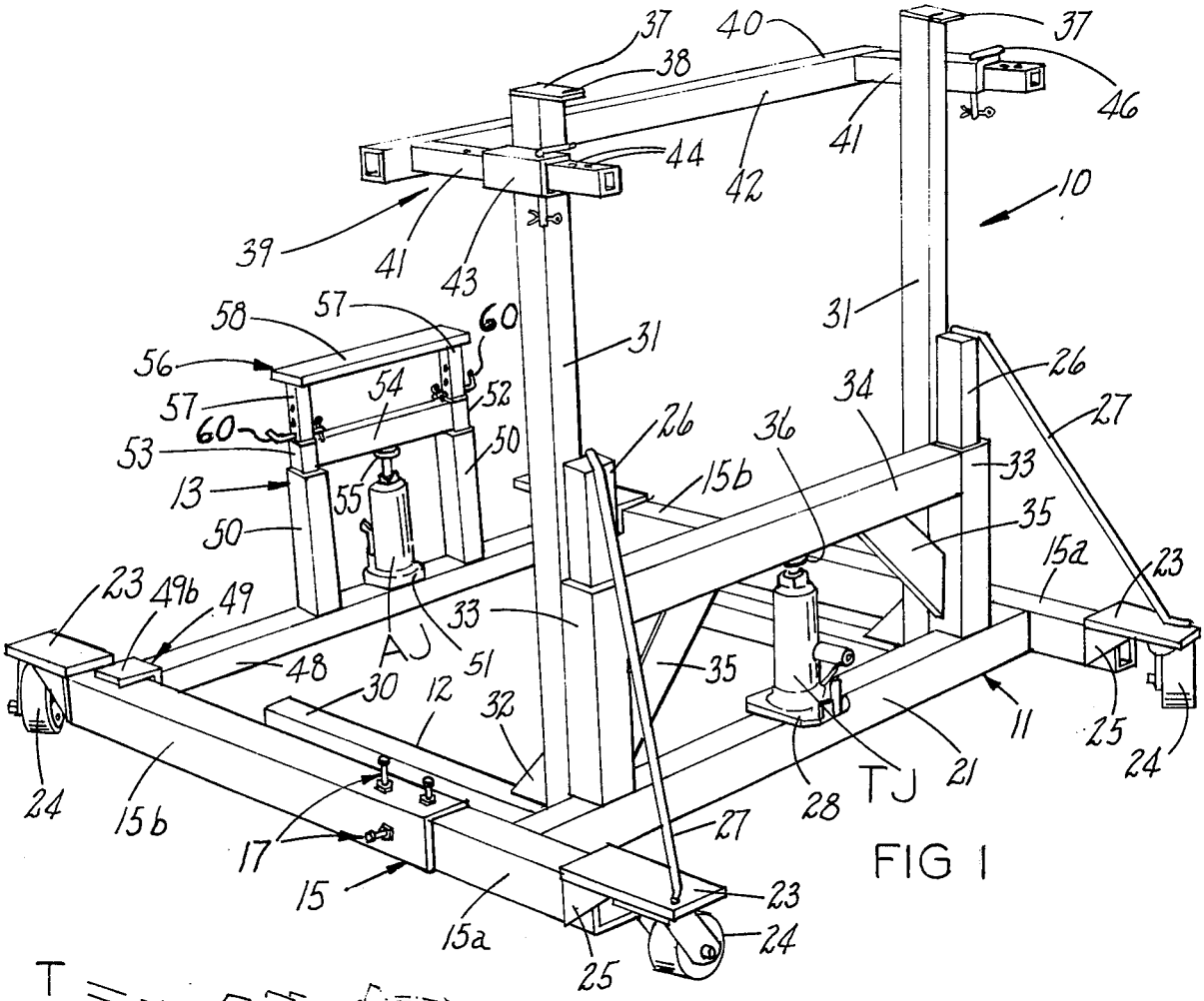
FIG. 1 is a perspective view of a wheel lift embodying the present invention.

Referring to FIGS. 1–9 of the drawings wherein a preferred embodiment is disclosed, the invention comprises a wheel lift apparatus designated generally by the numeral 10. The wheel lift apparatus 10 is of the truck or dolly type for moving large or heavy loads, and is especially adapted for handling dual tractor tires "T" mounted on wheels "W" and an axle assembly "A", as illustrated diagrammatically in phantom lines in FIGS. 2 and 3 for purposes of disclosure only and not by way of limitation as to other types of tires or loads. Referring particularly to FIGS. 1 and 4–9, the wheel lift 10 comprises a main or base frame assembly 11, a tire or wheel lift frame assembly 12 and an axle lift frame assembly 13. As will be readily apparent from the drawings, the respective assemblies 11, 12 and 13 are formed primarily from metal tubing of non-circular cross-section, preferably square, and provide a strong support structure for the wheel-mounted tires T and axle assembly A.

Figure 4:
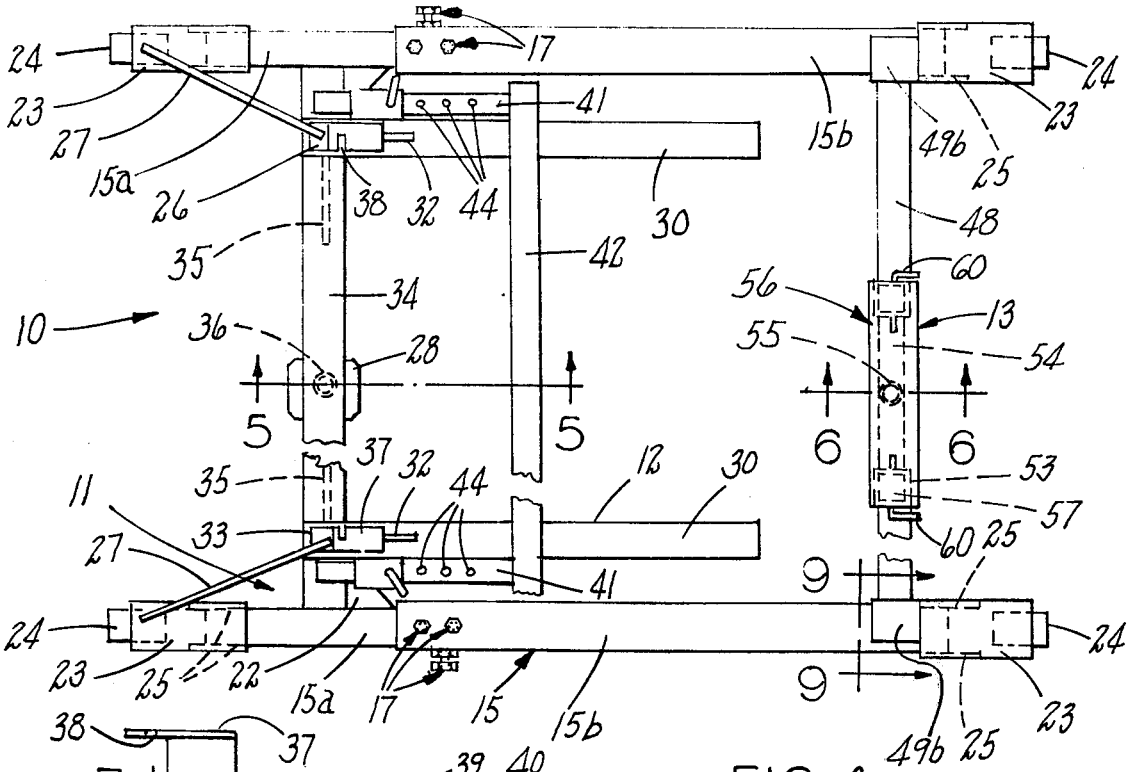
FIG. 4 is a top plan view of the wheel lift shown in FIG. 1.
Figure 5:
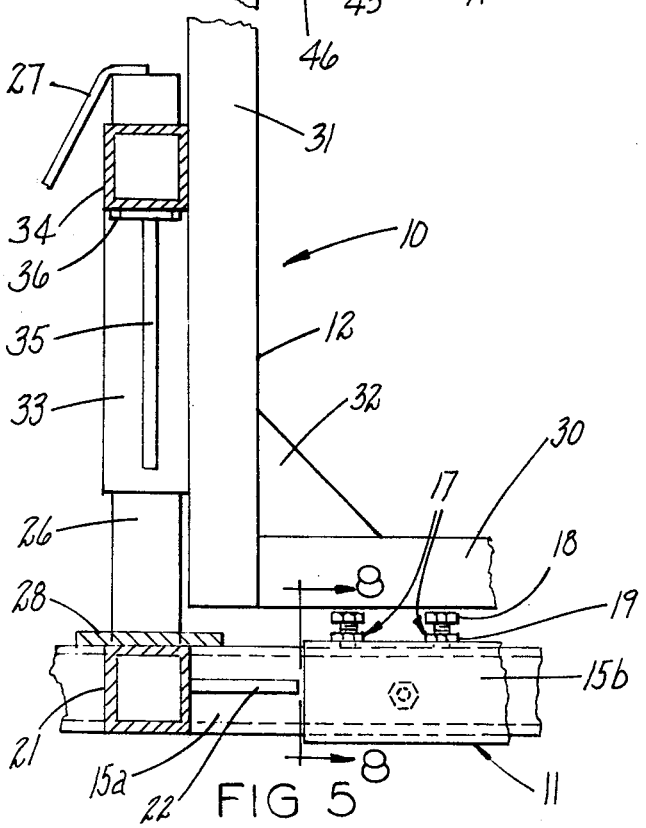
FIG. 5 is an enlarged fragmentary cross-sectional view taken substantially along the line 5—5 of FIG. 4, but showing an elevated position of the tire lift assembly.
Figure 6:
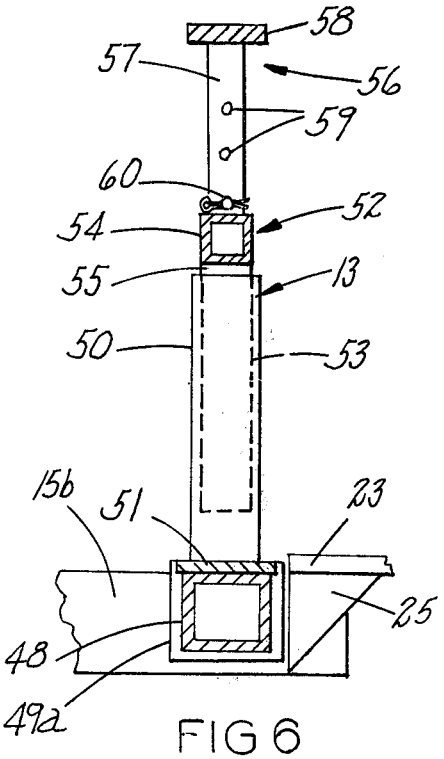
FIG. 6 is an enlarged fragmentary cross-sectional view taken substantially along the line 6—6 of FIG. 4.

As shown best in FIGS. 1, 4 and 5, the base frame assembly 11 comprises spaced apart, horizontally extending, substantially parallel, leg or side frame members (generally identified by the numeral 15), each of which includes two longitudinal tubular leg sections **15*a*, 15*b*. The inner leg sections 15*a* are slidably received within the outer leg sections 15*b* for relative telescopic adjustment thereof for selectively changing the longitudinal length of the base frame assembly 11 and the effective loading area of the wheel lift 10 in order to handle single or dual wheels or to accommodate different sized tires. Each of the outer leg sections 15*b* carries a plurality of similar locking means 17 comprising lock bolts 18 threadedly received in nuts 19 welded to the sections 15*b* in alignment with openings 20 therein, whereby the lock bolts 18 can be tightened against the inner leg sections 15*a* to releasably secure the sections 15*a* and 15*b* together, see FIG. 8. The side frame members 15 are interconnected by a cross frame member 21, the ends of which are rigidly secured, as by welding, to the side sections 15*a* and the juncture is further strengthened by gussets or triangular braces 22. The forward free ends of the outer side sections 15*b* and the rearward free ends of the inner side sections 15***a* are provided with mounting pads 23 to which caster wheels 24 are swivelly attached for complete rotation thereby forming a fully mobile base frame 11 for the wheel lift 10. The mounting pads 23 are reinforced by gussets or triangular support braces 25 welded to the side frame members 15 and the pads 23. The base frame assembly 11 also includes laterally spaced, vertical or upright guide members 26 having their lower ends rigidly secured, as by welding, to the horizontal portion of the base frame defined by the side and cross frame members 15 and 21, and preferably the vertical guide members 26 are secured to the cross frame member 21 laterally inwardly of the side frame members 15*a*. As seen best in FIGS. 1 and 4, the guide members 26 are further supported in vertical position by rod-shaped frame braces 27, which extend angularly outwardly and downwardly between the upper ends of the guide post members 26 and the rearward caster mounting pads 23 and are secured thereto. It will be apparent that the frame braces 27 stabilize the guide members 26 against the forces exerted thereon through the tire lift assembly 12 by the weight of the wheel-mounted tires T and, in addition, the upper portion of the frame braces 27 also function as an upper stop member limiting relative vertical movement of the lift frame assembly 12 on the guide members 26. The cross frame member 21 of the base frame 11 is provided with a jack plate 28 positioned substantially equidistant between the side frame members 15*a* and being rigidly secured to the upper surface of the cross frame member 21, as by welding. The jack plate 28 is adapted to seat a conventional standard height stroke jack "TJ" for effecting limited vertical movement of the tire lift assembly 12 relative to the base frame dolly 11.

Figure 3:
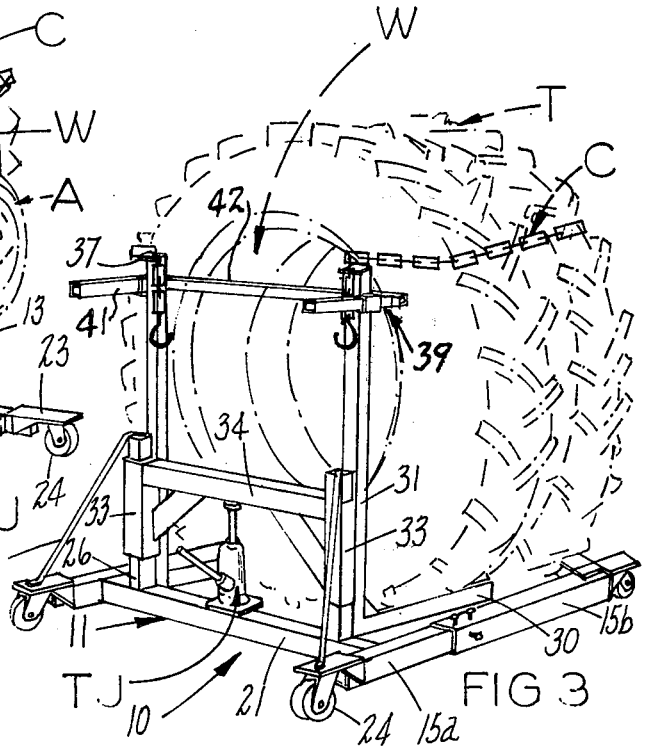
FIG. 3 is another perspective view, on a reduced scale, illustrating the lifting operation of dual tractor tires from a different angle than FIG. 2.

Still referring particularly to FIGS. 1, 4 and 5, the tire lift frame assembly 12 forms the principal supporting means for the primary load of single or dual wheel-mounted tractor tires T or the like, and comprises a pair of laterally spaced L-shaped lift arms including horizontal, load contacting, arm members 30 and vertical, load contacting, arm members 31 rigidly secured together, as by welding, and with gusset or triangular braces 32 also being provided at the juncture of the arm members 30 and 31. The vertical arm members 31 are rigidly secured, as by welding, to tubular, vertically extending, slide members 33 slidably received on the vertical guide posts 26 of the base frame 11, and the slide members 33 are rigidly interconnected at their upper ends by a laterally extending jack frame cross member 34. A pair of jack frame braces 35 are angularly disposed between the lower portions of the slide members 33 and the jack frame member 34 to provide further rigidity and strength. A circular jack ring 36 is welded to the lower surface of the jack frame cross bar 34 substantially equidistant from the slide members 33 and in opposed relation with the jack plate 28 on the base frame cross member 21. It will now be apparent that the jack TJ has its base supported on the jack plate 28 of the base frame cross bar 21 and its piston head is positioned within the jack ring of the opposed cross frame member 34 of the tire lift assembly 12, whereby conventional operation of the jack TJ will effect the vertical displacement of the lift frame assembly 12 between lower load orienting and upper load supporting positions relative to the base frame dolly 11. It will be noted that the lift arm assembly 12 is laterally disposed between the side frame members 15 of the base frame 11 and, in the lower load orienting position, the load supporting arms 30 are vertically positioned below the base frame side members 15 in proximity with the floor. When the wheel lift 10 is oriented with the tire load T with the lift arms 30 disposed on both sides of the tire axis and the jack TJ is actuated, the lift frame assembly 12 is elevated to engage and support the tire load. This primary load exerted by wheel-mounted tires T bears upon the lift arm members 30 and is carried by the vertical arm members 31 through the slide members 33 and guide posts 26 and through the jack frame cross member 34 and jack TJ to the base frame assembly 11. Referring briefly to FIG. 3, it will be seen that the load contacting, vertical arms 31 also directly receive part of the primary load by reason of the force exerted thereagainst by the tires T. Referring again to FIGS. 1, 4 and 5, the upper ends of the vertical arms 31 are capped by chain hook plates 37 which project rearwardly beyond the arm members 31 and have opposed slots or notches 38 adapted to secure a chain "C" in encircling relationship with the tires T, but this feature is primarily beneficial in the handling of single tractor tires T. A single tire adapter 39 is also provided on the tire lift frame assembly 12 and comprises a U-shaped, load contacting, frame 40 horizontally adjustably mounted on the vertical arm members 31 adjacent to their upper ends, the frame 40 including a pair of laterally spaced arm members 41 interconnected at their forward ends by a cross bar member 42. The arm members 41 are slidably received in tubular guide members 43 secured, as by welding, to the laterally outward surfaces of the vertical arm members 31. The arms 41 each have plural sets of vertically aligned openings 44 and the guide member 43 has at least one set of openings 45 for receiving a locking pin 46 (FIG. 7) to releasably secure the load contacting frame 40 to the tire lift assembly 12 in any preselected position to effectively adjust the load contacting area of the horizontal arm members 30 to accommodate single or dual tractor tires T including tires of different sizes.

Referring to FIGS. 1, 4, 6 and 9, the axle lift frame assembly 13 is adapted to support a tractor axle assembly A as a secondary or supplemental load contacting means, and is removably carried on the forward ends of the forwardly extending, outer leg sections 15*b* of the main frame assembly 11. The axle lift assembly 13 comprises a base frame including a cross beam member 48 adapted to span the lateral distance between the forward base frame side sections 15*b*. Angle support members 49 are secured, as by welding, to the ends of the cross beam member 48, and include vertical walls 49*a* for abutment against the opposed surfaces of the outer sections 15*b* and horizontal walls 49*b* adapted to seat upon the upper surfaces of the outer sections 15*b* whereby the axle lift frame assembly 13 is supported by the base frame 11 immediately adjacent to the forward casters 24, see FIG. 9. A pair of laterally spaced, tubular guide members 50 are centrally located on the cross beam member 48 and secured thereto in upright position, as by welding. A jack plate 51 is welded to the center of the cross beam 48 between the two upright guide members 50, and another conventional jack "AJ" is seated on the jack plate for limited vertical actuation of an axle jack frame assembly 52. The axle lift jack frame assembly 52 includes spaced, tubular, vertical slide members 53 slidably received in the guide members 50, and a cross jack beam 54 extends between and rigidly interconnects the upper ends of the slide members 53 and has a circular jack ring 55 welded to its lower surface in opposed relation with the jack plate 51 on the base cross member 48. It will be clear that the jack AJ has its base positioned on the jack plate 51 and its piston head positioned within the jack ring 55, whereby conventional jacking operation will effect vertical displacement of the jack frame 52 between lower load orienting and upper load supporting positions relative to the base frame assembly. It should be noted that the upper ends of the tubular slide members 53 are open and define internal guide means for an upper axle lift support assembly 56. This support assembly 56 comprises a pair of spaced vertical leg members 57 slidably received in the tubular slide members 53 and an axle support cross plate 58 extends laterally across and is secured to the upper ends of the leg members 57 to form a rigid axle supporting frame 56. The opposed walls of the vertical legs 57 of the support frame 56 have plural sets of vertically spaced transverse openings 59 adapted to receive an L-shaped locking or supporting rod 60, and it should be noted that the supporting rods 60 bear upon the upper surface structure of the axle jack frame assembly 52 and also form load carrying means, see FIG. 2. The leg members 57 of the support frame thus may be arranged in a plurality of vertically adjusted positions relative to the lower portion of the axle lift assembly 13 to position the support cross plate 58 proximinally with a wheel axle A to be removed from a tractor (not shown).

Figure 2:
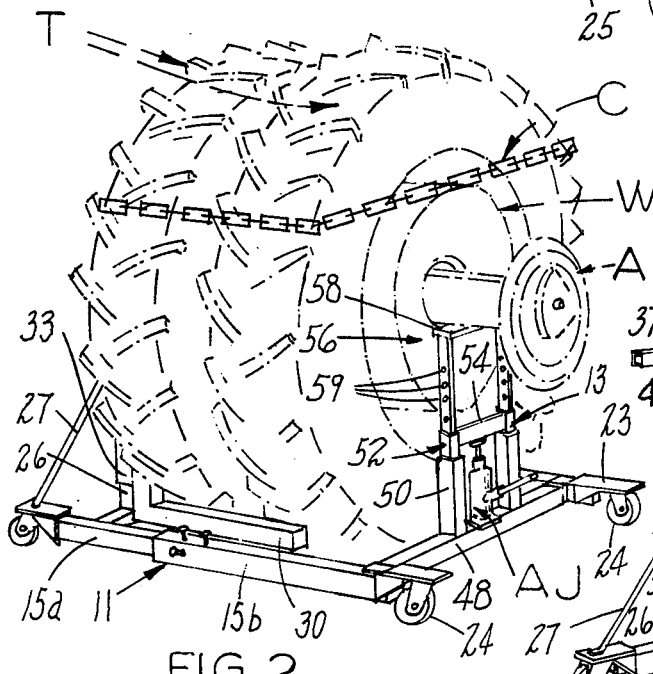
FIG. 2 is a perspective view, on a reduced scale, illustrating the lifting operation of dual tractor tires and an axle therefor on the wheel lift of FIG. 1.

In the operation of the wheel lift apparatus 10 and with particular reference to FIGS. 2 and 3, the axle lift frame assembly 13 is completely removed from the base frame assembly 11 and the tire lift frame assembly 12 is in its lower tire orienting position (by retraction of the piston of the jack TJ) so that the horizontal arms 30 are positioned adjacent to the floor and, together with the base frame side members 15, define an open front condition. Accordingly, the wheel lift 10 is easily manuevered on the swivel casters 24 into an oriented position under the tractor tires T. It should be understood that in normal practice the tractor or such implement (not shown) will already be elevated or jacked up by using a conventional rear splitting stand (not shown) or the like so that the rear wheels (tires T) are off the floor and ready for removal. In oriented position, the wheel lift arms 30 and base side members 15 extend forwardly underneath the tires T and straddle a vertical line drawn to the wheel axis, and the vertical load supporting arms 31 or the cross bar 42 of the single tire adapter 39 will abut the outer tire surface. The side frame sections **15*a* and 15*b* are telescopically adjustable in a forward longitudinal direction extending toward the tractor in order to adjust and stabilize the length of the base frame 11 for the purpose of supporting dual tires T (and axle A) or a single tire T and also for the purpose of preventing interference or contact of the wheel lift 10 with the tractor or splitting stand equipment supporting it. It will be apparent that the leg sections 15*a* and 15*b* are relatively longitudinally adjustable by loosening the lock bolts 18 and expanding or retracting the outer sections 15*b* on the inner sections 15*a* to the desired length, and then tightening the lock bolts 18** against the inner section.

When the wheel lift 10 is in oriented position, the tire jack TJ is actuated to raise the tire lift assembly 12 relative to the base frame 11 to firmly engage the support arms 30 with the tires T to permit selective removal of the outer tire and wheel (single) or both tires and wheels (dual). Assuming that dual tires and the axle A are to be removed (as shown in FIGS. 2 and 3) as to facilitate servicing of the tractor, the axle lift frame assembly 13 in its retracted or collapsed condition is reassembled on the front of the base frame legs 15, and the upper axle lift support assembly 56 is raised to position the axle support plate 58 immediately next to the axle A and the support rods 60 are inserted in the lowest exposed set of openings 59. The axle jack AJ is then actuated to raise the axle jack frame 52 relative to the wheel lift base frame 11 to firmly engage the axle support plate 58 against the axle A and remove its weight from the axle retaining bolts (not shown) by which the axle assembly is secured to the tractor housing (not shown). For the removal of dual tires T and the axle A, the single tire adapter 39 will be retracted rearwardly with its load contacting cross bar positioned adjacent to the vertical arms 31 of the tire lift frame 12, and it should be noted that the tires T will be supported in a substantially upright position on the tire lift arms 30 by the adapter 39 and axle lift assembly 13. The axle mounting bolts (not shown) are then removed to release the axle A and wheel-mounted tires T from the tractor, and the wheel lift dolly 10 can then be removed outwardly to facilitate tractor servicing in which case the tires and axle may be retained on the tire wheel lift 10 to be rolled directly back to the tractor for easy, pre-aligned re-installation.

Single tire and wheel assemblies can also be pulled from the axle A (and the axle separately removed from the tractor) for repair or replacement in which case the single tire adapter 39 may be extended forwardly to selectively reduce the effective load support area of the tire lift arms 30 and/or the chain C may be placed around the tire T and horizontally adjusted (preferably by a conventional chain tightener) against the vertical load contacting means 31 41 and locked in the chain plate notches 38. The tires T are removed from the wheel lift 10, after removal from the tractor (axle A) for tire or wheel servicing, by lowering the lift arm assembly 12 to its tire orienting position and releasing the chain C so that the tire rests on the floor and the wheel lift 10 can then be rolled away from beneath the tire T. It will be clear that tires removed from the wheel lift 10 are re-positioned and supported thereon for re-assembly on the tractor axle by reversing the procedures discussed.

Figure 10:
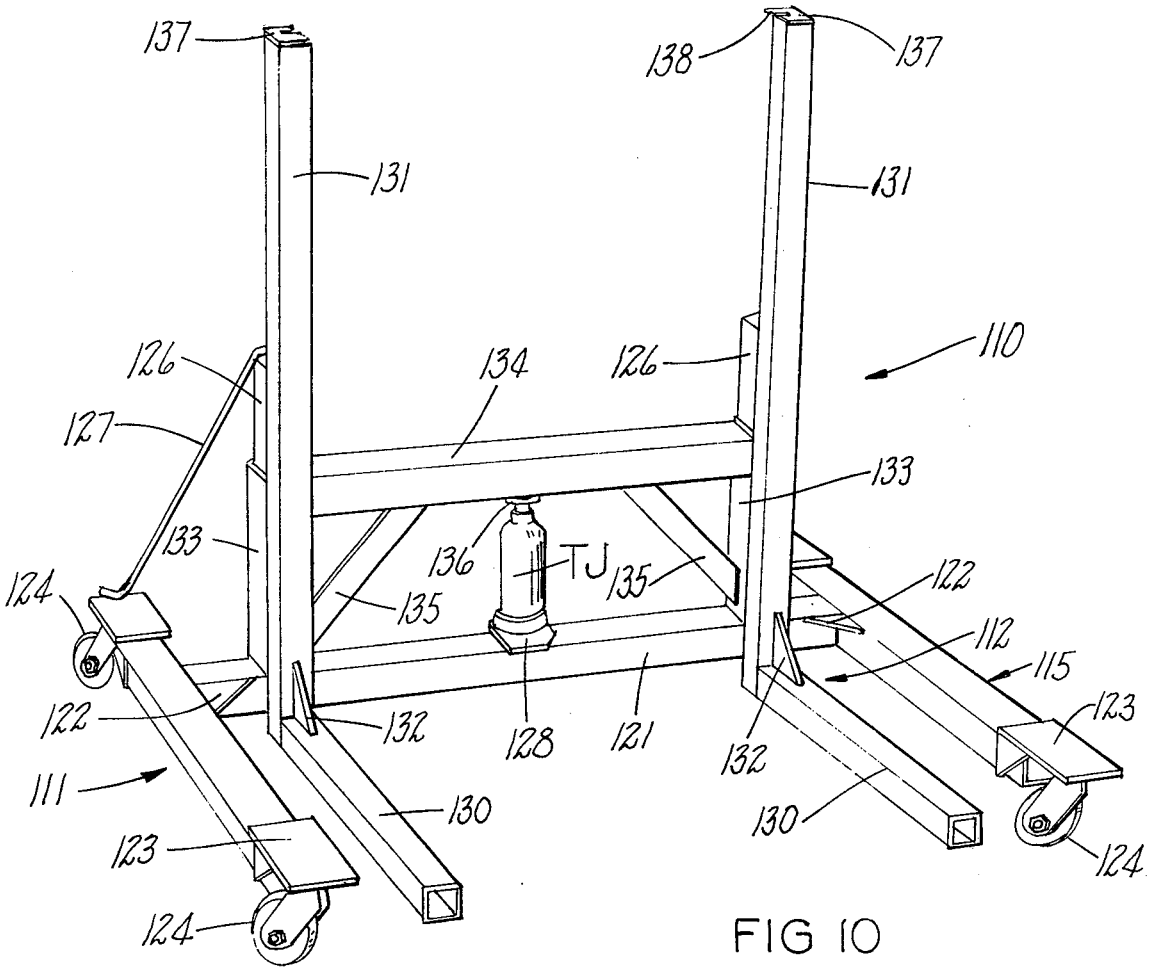
FIG. 10 is a perspective view showing another embodiment of the wheel lift.
Figure 7:
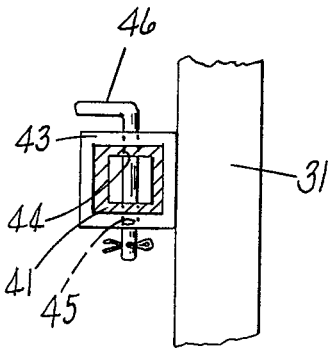
FIG. 7 is an enlarged fragmentary cross-sectional view taken substantially along line 7—7 of FIG. 5.
Figure 8:
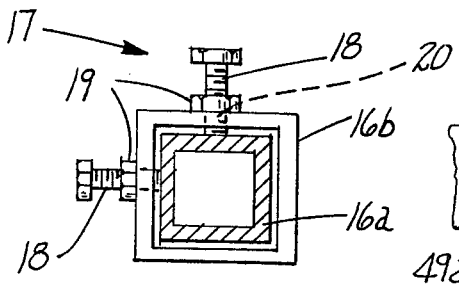
FIG. 8 is an enlarged fragmentary cross-sectional view taken substantially along line 8—8 of FIG. 5.
Figure 9:
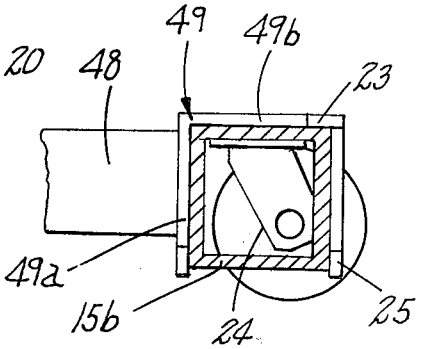
FIG. 9 is an enlarged fragmentary cross-sectional view taken substantially along line 9—9 of FIG. 4.

Referring now to FIG. 10 of the drawings wherein another embodiment of the tractor wheel lift apparatus 110 is disclosed, the respective parts corresponding to similar parts in the FIG. 1 embodiment are identified by numerals in the "100" series. The wheel lift apparatus 110 comprises a base frame assembly 111 having longitudinal, horizontally extending side frame members 115 mounted on caster wheels 124 and being interconnected in spaced apart, substantially parallel relationship by a cross frame member 121 which also supports vertical guide members 126 inwardly of the side members 115. A tire lift frame assembly 112 includes L-shaped arm frames having horizontal, load contacting arm members 130 connected to vertical, load contacting, arm members 131 secured to a jack frame assembly having vertical slide members 133 slidably positioned on the guide members 126 and being rigidly interconnected by a cross frame member 134. A conventional jack TJ is centrally positioned between the cross frame members 121 and 134 of the base frame 111 and tire lift frame 112 for vertical actuation of the latter between lower tire orienting and upper tire supporting positions. The tractor wheel lift 110 is particularly adaptable to "single"

tire removal for servicing and re-installation, and the operation thereof will be fully understood by reference to the previous description of the operation of the wheel lift 10.

It will be readily apparent from the foregoing description that the wheel lift 10 110, through vertical and horizontal adjustment of its load contacting or supporting members, greatly facilitates precise orientation with wheel-mounted tires T and axle assemblies A for easy removal, servicing and re-installation on a tractor or like vehicular equipment; and that the objects and advantages of the present invention are fully met. It will also be readily apparent to those skilled in the art that various changes and mofidications may be made without departing from the spirit and scope of the invention as it is more precisely defined in the subjoined claims.

What is claimed is:

1. A wheel lift apparatus for lifting and supporting wheel-mounted vehicle tires as a primary load, comprising a mobile base frame assembly including substantially parallel, longitudinal side frame members mounted on casters, a cross frame member rigidly interconnecting said side frame members adjacent one end thereof, said side and cross frame members forming a horizontal portion of said base frame assembly, and vertical guide means projecting upwardly from said horizontal portion; a lift frame assembly adapted for limited vertical movement between lower primary load orienting and upper primary load supporting positions relative to said base frame assembly, said lift frame assembly comprising first means for contacting the primary load in one plane thereof, and second means for contacting the primary load in a plane substantially normal to the first means; and an axle lift frame assembly for lifting and supporting an axle assembly associated with the vehicle tires as a secondary load, comprising a cross beam extending laterally of the base frame assembly and being removably attached to the side frame members thereof, said cross beam having vertical guide means projecting upwardly intermediate its ends, and axle support means including a jack frame adapted for vertical movement relative to the cross beam for lifting and supporting the secondary load.

2. The wheel lift apparatus according to claim 1, in which said first means of said lift frame assembly comprises horizontal load supporting arms defining a horizontal loading area for the primary load, vertical arms secured to said horizontal arms, and said second means comprises load contacting adapter means horizontally adjustably mounted on said vertical arms and being adapted for engagement with the primary load and effectively varying the horizontal loading area therefor.

3. The wheel lift apparatus according to claim 1, in which said axle support means of said axle lift frame assembly also includes a support frame vertically slidably carried by said jack frame, and incremental means for effecting vertical adjustment between said support frame and jack frame.

4. The wheel lift apparatus according to claim 1, in which each of said longitudinal side frame members of said mobile base frame assembly includes a pair of tubular, telescopically adjustable leg sections mounted on casters at their remote ends, and locking means for releasably securing the leg sections in preselected adjusted relationship to provide stability of said base frame relative to the adjusted horizontal loading area for the primary load.

5. The wheel lift apparatus according to claim 1, in which said jack frame of said axle lift frame assembly has vertical legs slidably engaging said vertical guide means of said cross beam and a cross jack beam rigidly interconnects said vertical legs and is adapted for vertical movement relative to said cross beam, said axle lift frame assembly also including a support frame having vertical legs slidably engaging the vertical legs of said jack frame and a support plate rigidly interconnecting said vertical legs and being adapted for supporting engagement with a secondary load, said vertical legs of said support frame having vertically spaced sets of openings therein for receiving fail-safe, load bearing, locking bars for selective incremental vertical adjustment of the support frame relative to the jack frame.

6. A jack frame apparatus adapted for lifting and supporting engagement with a vehicle part to facilitate service and/or repair of the vehicle, comprising a base frame including a cross beam member carried on spaced apart casters adjacent each end thereof for providing mobility of said apparatus to and from the vehicle part, vertical guide means projecting upwardly from said cross beam member; a jack frame assembly having vertical leg means slidably engaging said vertical guide means, a cross frame member rigidly interconnecting said vertical leg means, and means disposed between said cross beam and cross frame members for effecting vertical adjustment of the jack frame assembly relative to the base frame; and a support frame assembly having vertical leg means for cooperable sliding engagement with the jack frame vertical leg means, a support plate rigidly interconnecting the support frame vertical legs and being adapted for supporting engagement with the vehicle part, and said support frame vertical legs each having vertically spaced sets of openings therein for receiving fail-safe, load bearing locking bars for selective, incremental, vertical adjustment of the support frame assembly relative to the jack frame assembly.

7. An axle jack frame assembly adapted for cooperable use with a vehicle wheel lift apparatus having a mobile base frame and a lift frame mounted on the base frame for relative vertically adjustable, supporting engagement with a wheel-mounted vehicle tire; said axle jack frame assembly comprising a base member adapted to be removably engaged on the base frame of a wheel lift apparatus, jack frame means adapted for vertical adjustment relative to the base member including jacking means to effect said relative vertical adjustment, and axle support frame means including vertical legs slidably carried by said jack frame means and an axle support plate secured to said vertical legs, said vertical legs having vertically spaced sets of openings therein for the selective positioning of locking bars that are engagable upon said jack frame means for effecting relative incremental vertical adjustment between said axle support frame means and jack frame means.

8. A jack frame apparatus adapted for lifting and supporting engagement with a vehicle part to facilitate service and/or repair of the vehicle, comprising a horizontal base frame member adapted to be carried on spaced casters for providing mobility of said apparatus; a jack frame assembly including a horizontal cross frame member disposed above said base frame member, cooperable relatively slidable guide and leg means extending between said base frame and cross frame members, and means disposed between said base frame and cross frame members for effecting substantially vertical adjustment of the jack frame assembly relative to the base frame member; a support frame assembly including a support plate member disposed above the cross frame member of said jack frame assembly and being adapted for vertical adjustment relative thereto for supporting engagement with a vehicle part, one of said jack frame and support frame assemblies having vertical leg means and the other having cooperable vertical guide means for said vertical leg means, and means for effecting relative incremental vertical adjustment between said jack frame and support frame assemblies comprising vertically spaced sets of openings in one of said vertical leg means and cooperable guide means for the selective positioning of locking bars therethrough for engagement with the other of said vertical leg means and cooperable guide means.

9. A jack frame apparatus adapted for lifting and supporting engagement with a vehicle part to facilitate service and/or repair of the vehicle, comprising a base frame including a cross beam member adapted to be carried on spaced apart casters for providing mobility of said apparatus; a jack frame assembly including a cross frame member disposed above said cross beam member, one of said cross beam and cross frame members having guide means secured thereto and the other of said members having cooperable leg means slidably engaging said guide means, means disposed between said cross beam and cross frame members for effecting substantially vertical adjustment of the jack frame assembly relative to the base frame; a support frame assembly including a support plate member disposed above the cross frame member of said jack frame assembly and being adapted for vertical adjustment relative thereto for supporting engagement with a vehicle part, vertical guide means on one of said jack frame and support frame assemblies and the other having cooperable vertical leg means slidably engaging said vertical guide means, and manually adjustable, fail-safe, locking means for effecting the selective, incremental, vertical adjustment of the support frame assembly relative to the jack frame assembly comprising vertically spaced sets of openings in at least one of said cooperable vertical means and vertical leg means, and load bearing locking bars positioned in a selected set of openings for locking engagement with the other of said cooperable vertical guide means and vertical leg means.

* * * * *